United States Patent [19]

Itey-Bernard

[11] 4,215,971

[45] Aug. 5, 1980

[54] LIFT TRUCK

[75] Inventor: Georges Itey-Bernard, Garches, France

[73] Assignee: Regie Nationale des Usines Renault, Boulogne Billancourt, France

[21] Appl. No.: 915,889

[22] Filed: Jun. 15, 1978

[30] Foreign Application Priority Data

Jun. 29, 1977 [FR] France ..... 77 19913

[51] Int. Cl.[2] ..... B66C 23/00

[52] U.S. Cl. ..... 414/696; 414/728; 414/742; 414/917

[58] Field of Search ..... 414/728, 742, 917, 696, 414/712, 694, 710, 630, 631, 628, 634–636, 639

[56] References Cited

U.S. PATENT DOCUMENTS

| | | | |
|---|---|---|---|
| 958,911 | 5/1910 | Durkee | 414/742 X |
| 1,623,194 | 4/1927 | Marshall | 414/694 |
| 2,276,483 | 3/1942 | Hahn | 414/696 |
| 2,598,685 | 6/1952 | Greenlief | 414/728 X |

FOREIGN PATENT DOCUMENTS

| | | | |
|---|---|---|---|
| 11964 | of 1915 | United Kingdom | 414/742 |

*Primary Examiner*—Stephen G. Kunin
*Assistant Examiner*—Edmond G. Rishell, Jr.
*Attorney, Agent, or Firm*—Fleit & Jacobson

[57] ABSTRACT

The lift truck of the invention comprises a frame, a mast adapted to be lifted in relation to the frame, a fluid-operated cylinder for controlling the ascent and descent of the mast, a load-supporting platform rigid with the mast, a first pivot pin carried by the lower end of the mast and rigid with a movable slide block guided horizontally along the lower portion of the frame. The slide block carries the pivot pin of a positioning rod for positioning the load supporting platform and a supporting rod, having a length equal to one-half of the distance between the pivot pin of the mast on the slide block and the pivot pin of the load supporting platform on the mast, is pivoted to the mast and to the lower portion of the frame ahead of the slide block.

7 Claims, 3 Drawing Figures

LIFT TRUCK

BACKGROUND OF THE INVENTION

This invention relates in general to material handling equipments and has specific reference to an improved lift truck of the type comprising a load-carrying platform movable vertically under the control of a hoisting device comprising a mast mounted at the front end of the truck and supporting said platfrom.

This invention is concerned more particularly with a lift truck capable of meeting the requirements of safety regulations in force and of which the hoisting device cannot interfere with the stability, dimensional limits or mass of the truck.

It is known that a good truck stability is essential for improving its safety of operation and its performances in actual service, such as speed, acceleration and braking, while reducing to a large extent the load ascent and descent times.

Hitherto known lift trucks comprise as a rule a mast, whether fixed or hingedly mounted, disposed ahead of the front drive-wheel axle, this mast constituting the means for guiding a load-carrying platform adapted to receive tools such as forks, clamps or other specialized tools. Under the control of a hydraulic cylinder, the load can travel parallel to the mast.

This conventional structure leads to the construction of lift trucks supporting the load ahead of the front-drive axle, so that the steering rear axle must be ballasted in order to transfer the centre of gravity of the truck inside its polygonal basis of support. As a rule, this polygonal basis is an isosceles triangle of which the vertices constitute the projection on the ground of the vertical pivot axis of the steering axle and the points of contact between the drive wheels and the ground. Therefore, known trucks are relatively bulky and heavy, so that their operation is attended by a considerable power consumption. Furthermore, the position of the centre of gravity above the ground increases the risks of tipping the truck, for example when changing its direction of travel or applying the brakes. It is also clear that the increment in the truck mass, its distribution and the position of its centre of gravity develop vertical, transverse and longitudinal inertia forces, and consequently stray movements tending to endanger the operator's safety and the truck load.

SUMMARY OF THE INVENTION

It is therefore the essential object of the present invention to provide a lift truck having an improved stability and wherein the assembly of means implemented for obtaining this improved stability do not modify in any way the overall dimensions and mass of the truck.

It is another object of this invention to provide a lift truck in which the hoisting means are so arranged that the operator's visibility is greatly improved.

It is a further object of this invention to provide a lift truck wherein the component elements of the hoisting device are positioned with a view to reduce appreciably the masses located ahead of the drive or front axle, lower the centre of gravity and increase the visual field of the operator.

According to this invention, the base of the hoisting mast carries a pivot pin rigid with a slide block mounted for longitudinal translation on the lower portion of the truck frame under the control of fluid-operated means.

In the lift truck thus constructed the hoisting mast can be moved to any desired inclined position, including a substantially horizontal position in which its centre of gravity lies between the two truck axles, thus improving considerably the static stability and the operator's field of vision.

Moreover, since the centre of gravity of the truck is located at a very low level above the ground, the truck becomes insensitive to dynamic effects resulting from its acceleration and decelerations.

Other features and advantages of the improved lift truck of this invention will appear as the following description of a typical form of embodiment thereof proceeds, reference being made by way of example to the attached drawing, in which:

DESCRIPTION OF THE PERFERRED EMBODIMENT

Figure 1:
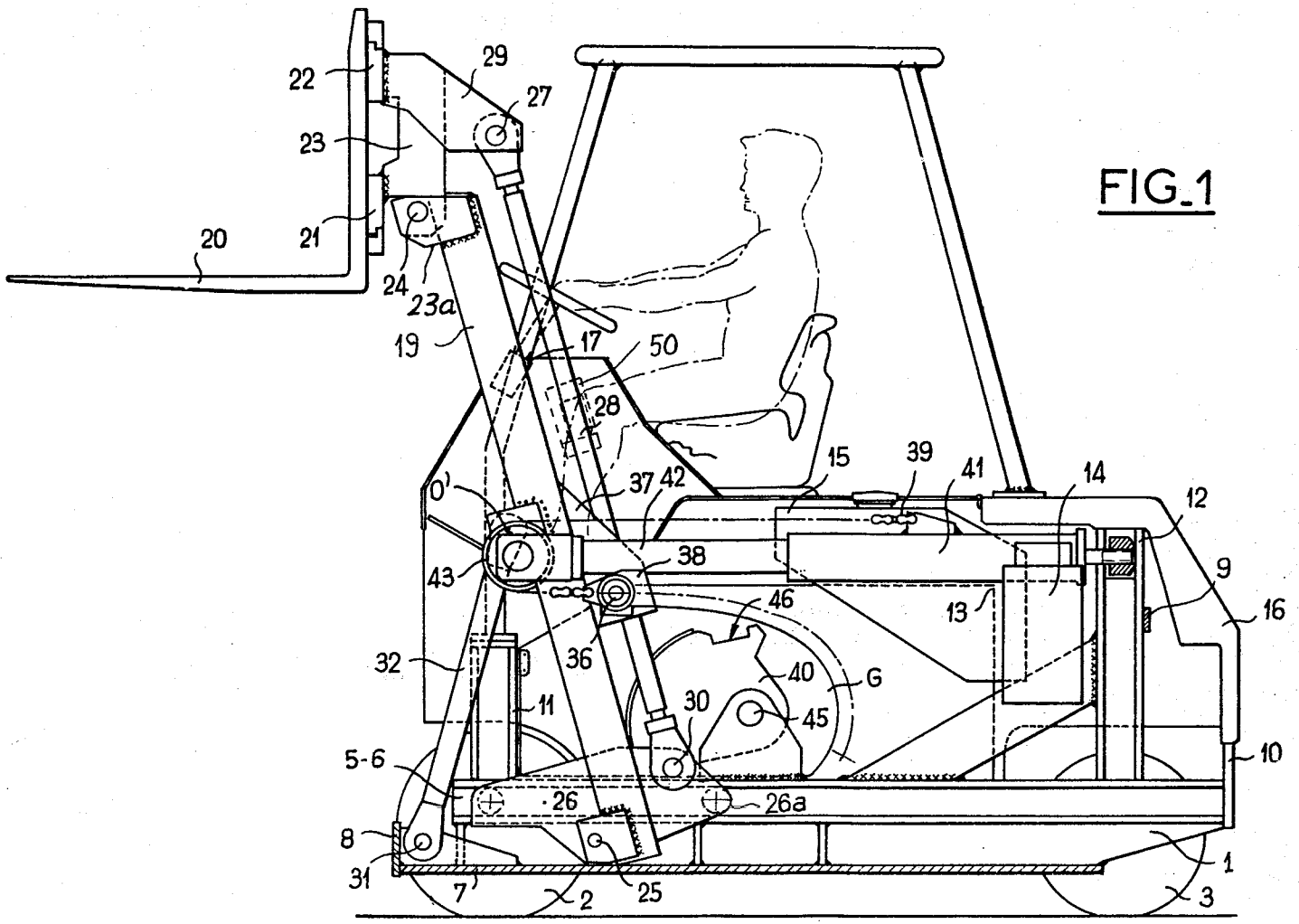
FIG. 1 is a diagrammatical side elevational view of the truck frame showing the hoisting mast and the load supporting platform in its uppermost position.
Figure 2:
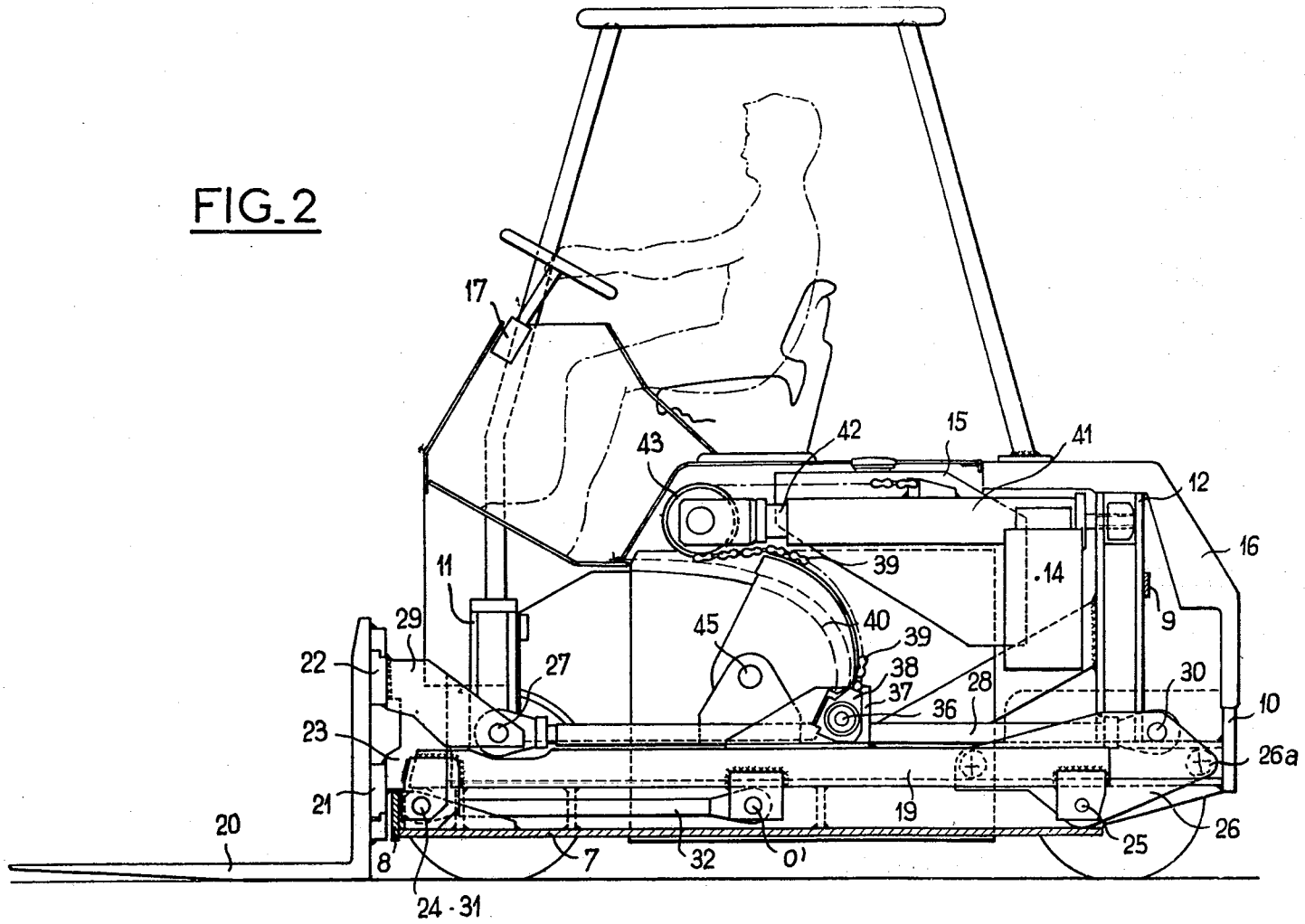
FIG. 2 is a view similar to FIG. 1 but showing the mast and platform control means in their lowermost position.
Figure 3:
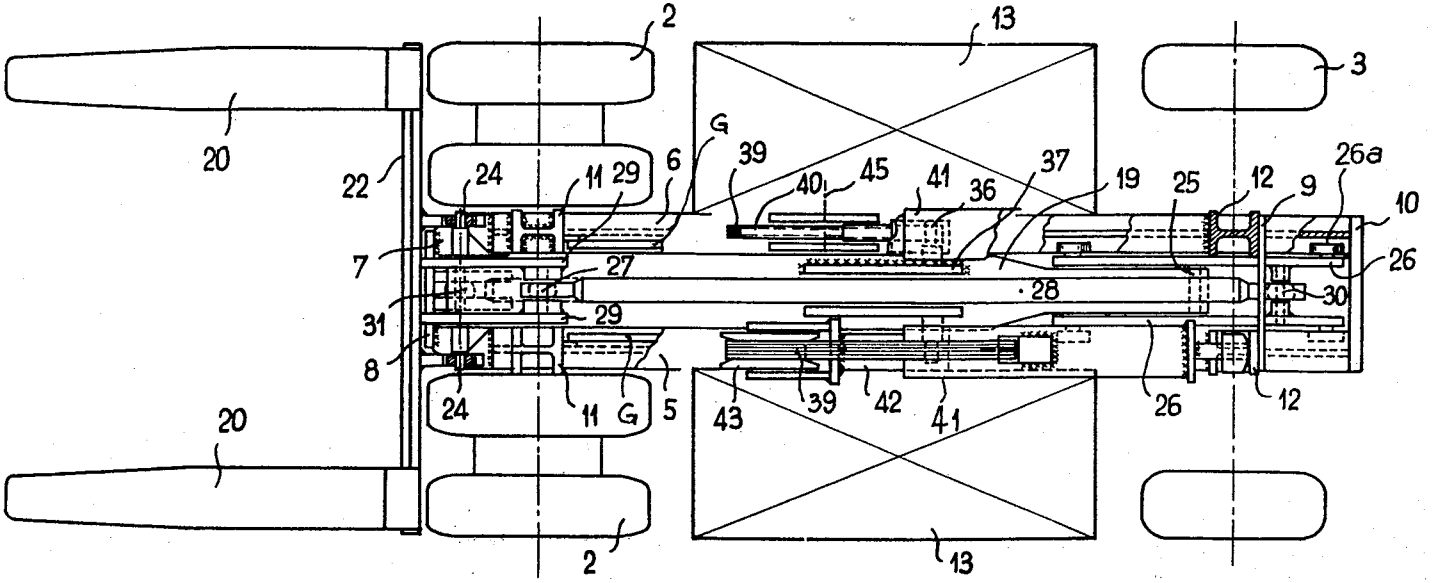
FIG. 3 is a plane view from above showing the truck with the load supporting platform in its lowermost position.

The truck illustrated in FIGS. 1 and 2 comprises a frame 1, a pair of drive wheels 2 and a pair of steering or driving-cum-steering wheels 3, mounted on front and rear axles, respectively, of the truck.

The frame 1 comprises essentially at its lower portion a pair of longitudinal side members 5, 6 supporting a connecting plate 7 and braced by three cross members 8, 9 and 10. Each longitudinal side member extends between the front and rear wheels 2, 3 and consists of an I-section member with horizontal wings directed towards the longitudinal centre line of the truck. The wings of the two section members 5, 6 constitute guide races for rollers, as will be explained presently.

A pair of vertical H-sectioned stanchions or like members 11 and 12 are each rigid with one of said longitudinal members 5 and 6, respectively. The front stanchions 11 support the axle of the drive wheels, and the rear stanchions 12 have anchored thereto two hydraulic cylinders to be described presently.

A number of ribs (not shown) are provided in order to impart to the frame the rigidity and strength necessary for absorbing the torque reaction of the truck and the reaction force of the control cylinder.

In the drawing, the storage batteries 13 for energizing the drive motor 14, the oil tank 15, the counterweight 16, one portion of the reinforced protection cab for the operator, as well as the steering mechanism 17, are shown only diagrammatically, since they are well known in the art.

The hoisting means illustrated more in detail in FIG. 1 comprise essentially at least one hoisting mast 19 consisting, for example, of a beam capable of withstanding severe torsional and flexion stresses. The front end of the mast 19 carries a load-supporting platform or like tool, in this example a conventional fork 20 for palletizing loads, of the variable-track type, supported by a pair of cross members 21, 22 interconnected by gussets 23 and extending transversely to the longitudinal centre line of the truck. The length of these cross members 21, 22 is substantially inferior to the overall width of the truck. The distance between the fork arms is adjusted in the conventional manner by causing said arms to slide on the cross members 21, 22. The load supporting platform is anchored to the mast 19 by means of a pin 24 carried by brackets 23*a*.

In order to meet the primary requirements of this invention, the hoisting mast is associated with means capable of assuming a horizontal position when the load platform is moved to its lowermost or bottom position.

According to the invention, the base of mast 19 carries a pivot pin 25 rigid with a slide block 26. The latter consists of a small guided carriage comprising essentially a pair of small longitudinal side members braced to each other and carrying four rollers 26*a* engaging the inner race-forming surfaces of the wings of the I-sectioned longitudinal members 5, 6 so as to be guided thereby. With this arrangement, the rollers 26*a* allow the movements of translation of slide block 26 and consequently the movements of the pivot pin 25 in a horizontal plane. The slide block or guided carriage 26 is also provided with another transverse pivot pin 30 to which one end of a main positioning rod 28 is pivoted, the other end of this rod 28 being pivoted to another pivot pin 27 secured to a pair of brackets 29 rigid with the upper cross member 22. By construction, the distance between the pivot pins 25 and 30 carried by the carriage 26 is equal to the distance between the axes of the pivot pins 24 and 27. These pivot pins 25, 30 and 24, 27 are on the other hand parallel to each other and lie in parallel planes, so that they constitute the vertices of a rigid parallelipipedic structure during the movements of carriage 26.

To obtain a vertical movement of the pivot pins 24, 27 during the forward movement of the slide block or carriage 26, the frame 1 carries the fixed pivot pin 31 of a support rod 32 having a length equal to one-half the distance between the pivot pin 25 of the hoisting mast 19 on the guide carriage 26, on the one hand, and the pivot pin 24 of the fork assembly 20–23, on the other hand. The pivot pin 31 is coaxial to the pivot pin 24 when the platform is in its lowermost position. The supporting rod 32 is pivoted on the other hand to the mast 19 about a pivot pin 0′ located intermediate the parallel pivot pins 25, 24 and in the plane containing the axes of these pivot pins.

The above-described structure is capable of lifting loads in a vertical plane under the control of power means to be described hereinafter with reference to the drawing.

The hoisting mast 19 carries means for anchoring a traction member coupled to a cylinder. These anchoring means consist of a bracket 37 welded to the mast. The bracket 37 carries the pivot pin 36 of a pivoted lug 38. This lug 38 is rigidly connected to the traction member consisting in this example of a chain 39 co-operating with the contact surface of a cam 40 rotatably mounted on a shaft 45. A pair of hydraulic cylinders 41 control the upward and downward movements of the mast. To this end, the body of each cylinder 41 is pivoted to a stanchion 12 and the piston rod 42 of the corresponding cylinder carries a tension roller 43 for the traction chain 39, this chain having its ends anchored the one to the lug 38 and the other to the cylinder 41, respectively. The traction or tension stress exerted on the chain 39 is supported by the shaft 45 of cam 40. To this end, the shaft 45 is carried by a bracket welded to an element of the truck frame 1. The contour of this cam 40 is such that the control effort transmitted to the mast 19 via chain 39 is directed substantially at right angles to said mast 19. For this purpose, the portion of chain 39 between the tension roller 43 and lug 38 is wound during one fraction of the movement of mast 19 over the cam 40 while preserving the coupling with play between the lug 38 and a notch 46 formed in said cam 40. At the end of the mast stroke, the lug 38 is disengaged from notch 46 and the engagement between the lug 38 and cam notch 46 is restored during the downward movement of the mast.

The above-described structure operates as follows:

When the cylinder or cylinders 41 are actuated by introducing fluid under pressure into them, the piston rods 42 pull the chain 39 and consequently the lug 38. The profile of cam 40 is such that the efforts exerted on the cylinders 41 and mast 19 are somewhat limited. According to a preferred form of embodiment of the present invention, the flexion stress exerted on the cylinder body may be reduced considerably and the velocity of operation of the mast 19 shall be calculated as a function of a law of variation of the cylinder control pressure. The vertical movements accomplished by the load-supporting platform and the corresponding movements of the piston rods 42 of said cylinders are governed by a law of variation taking due account of the cam profile and of the positions of anchoring points 37. More particularly, it will be possible to actuate the mast 19 by using a relatively moderate amount of power, and to store one fraction of this power during the downward movement of the mast either in the form of hydropneumatic energy stored in a reservoir connected to the cylinders 41, or by compressing spring means housed in the cylinder bodies.

Due to the tractive effort exerted through the chain 39, the slide-block or carriage 26 is moved along the longitudinal side members 5 and 6. This movement is attended by a pivotal movement of the supporting rod 32 about the fixed pivot pin 31. The pivot axis 0′ of rod 32 on mast 19 will thus describe a circular arc about the axis of pivot pin 31 and the platform provided with the fork arms 20 is moved vertically upwards, parallel to the vertical containing said axis of pivot pin 31.

Two vertical parallel plates G bolted to the corresponding side members 5 and 6 and on the vertical stanchions 11 at the front of the truck are provided for guiding the mast 19 during its ascent or descent, to prevent accidental lateral shifts of the mast and the load supported thereby.

The positioning rod 28 may comprise, if desired, an additional protection frame extending vertically in front of the operator's knees during the truck travel with the mast 19 in its retracted or lowermost position. When the load supporting platform is in the uppermost position shown in FIG. 1, the additional frame is located automatically above the operator's head to protect it against the possible fall of a load.

It would not constitute a departure from the scope of the invention to use double-acting control cylinders incorporated in the positioning rod 28, such as the cylinders 50 schematically illustrated in FIG. 1. In this case, the function of such cylinders would be to move the pivot pin towards or away from the pivot pin 30. This movement would permit, for a given position of the mast 19, a slight rotation of forks 20 about the horizontal pivot 24, notably for facilitating the picking up of a load.

It would also be possible to bring many modifications and changes to the load supporting mast and its control cylinder or cylinders without departing from the basic principles of the invention. In fact, control means comprising a fluid-operated cylinder adapted to actuate simultaneously with its traction member a pair of hoisting masts disposed on either side of the cylinder may be incorporated in the truck of this invention, without departing from its basic principles.

What is claimed as new is:

1. In a lift truck of the type comprising a frame, a mast adapted to be pivoted in relation to said frame, a fluid-operated cylinder for controlling the ascent and descent of said mast, a load-supporting platform operatively connected with said mast, a movable slide block, a first pivot pin carried by a lower end of the mast and operatively connected with the movable slide block, the slide block being guided horizontally along the lower portion of the frame for controlling mast movements, the improvements comprising a positioning rod, said positioning rod having a pivot pin at a lower end thereof for pivotally connecting said rod to said slide block for positioning the rod and the load supporting platform , a second pivot pin carried by an upper end of the mast and connected to the load supporting platform, and a supporting rod having a length equal to one-half of the distance between the first pivot pin of said mast on the slide block and the second pivot pin, said supporting rod being pivoted to said mast and to a lower portion of said frame ahead of said slide block, the frame including a pair of longitudinal side members for defining a guide race for the slide block controlling the mast movements.

2. A lift truck as set forth in claim 1, further comprising a traction member, means for anchoring the traction member carried by said mast, a reaction member cooperating with the anchoring means and fastened to the truck frame, and mast control means including said cylinder for moving said traction member.

3. A lift truck as set forth in claim 2, wherein the cylinder of the mast control means has a body having anchored thereto one end of said traction member, the traction member cooperating with a tension member controlled by said cylinder, an absorption member for absorbing reaction of the mast to a control effort, said absorption member being rigid with the truck frame.

4. A lift truck as set forth in claim 3, wherein the absorption member consists of a cam rotatably mounted by means of a pivot pin rigid with the truck frame, and that said cam has formed therein a notch adapted to be engaged with play by a lug carried by said traction member, said lug comprising a mast control member of said mast control means.

5. A lift truck as set forth in claim 4, wherein effort transmitted through said traction member is directed substantially at right angles to the mast.

6. A lift truck as set forth in claim 1, wherein said mast is disposed between two lateral guide members consisting of a pair of parallel vertical plates rigid with said longitudinal side members of the truck, and of front stanchions of the truck frame.

7. A lift truck as set forth in claim 1, wherein the rod for positioning the load supporting platform includes means for adjusting the length of said rod, said adjusting means partaking in rotation of said load supporting platform about its pivot axis, the pivot axis consisting of a pivot pin carried by the mast.

* * * * *